US007686433B2

(12) United States Patent
Domoto

(10) Patent No.: US 7,686,433 B2
(45) Date of Patent: Mar. 30, 2010

(54) MEMBRANE STIFFENER FOR ELECTROSTATIC INKJET ACTUATOR

(75) Inventor: Gerald A. Domoto, Briarcliff Manor, NY (US)

(73) Assignee: Xerox Corporation, Norwalk, CT (US)

( * ) Notice: Subject to any disclaimer, the term of this patent is extended or adjusted under 35 U.S.C. 154(b) by 190 days.

(21) Appl. No.: 11/842,751

(22) Filed: Aug. 21, 2007

(65) Prior Publication Data

US 2009/0051738 A1 Feb. 26, 2009

(51) Int. Cl.
*B41J 2/045* (2006.01)

(52) U.S. Cl. ..... 347/68

(58) Field of Classification Search ..... 347/68–69, 347/70, 71–72

See application file for complete search history.

(56) References Cited

U.S. PATENT DOCUMENTS 6,217,158 B1 * 4/2001 Kanaya et al. ..... 347/70

* cited by examiner

*Primary Examiner*—K. Feggins
(74) *Attorney, Agent, or Firm*—Marger Johnson & McCollom, P.C.

(57) ABSTRACT

An apparatus has an electrode plate having an array of electrodes, a flexible membrane separated from the electrode plate by a gap, the membrane having localized regions corresponding to electrodes in the array of electrodes, and each localized region having a stiffener. A print head has an ink reservoir, a nozzle plate to deliver ink from the reservoir to a print substrate, an ink inlet on an opposite side from the print substrate to provide ink from the reservoir to the nozzle plate, and a flexible membrane arranged so as to draw the ink through the ink inlet when actuated and to dispense the ink through the nozzle plate when released, the flexible membrane having a stiffener. A method of manufacturing a membrane device includes providing an electrode plate having an array of electrodes, forming an air gap adjacent the electrode plate, and forming a membrane of conductive material having localized regions with a stiffener, the localized regions corresponding to electrodes in the array.

20 Claims, 6 Drawing Sheets

MEMBRANE STIFFENER FOR ELECTROSTATIC INKJET ACTUATOR

BACKGROUND

Ink jet printers generally dispense ink onto a substrate through a nozzle plate that has an array of holes. Ink is loaded behind the plate and an actuator causes the ink to be pushed through the hole onto the print substrate. Generally, the number of holes corresponds to a particular number of dots per inch (dpi) for a printing system.

In many current ink jet printers, the actuators are an array of piezoelectric actuators. When the image data representing an image dictates that a drop should be printed onto the print substrate at a particular place, the piezoelectric actuator is activated. The actuator's motion or vibration causes the ink to be pressed through the hole in the nozzle plate onto the substrate.

It is possible to replace the piezoelectric actuators with an electrostatically actuated system using a flexible membrane. The flexible membrane may reside behind the nozzle plate where the ink fills between the flexible membrane and the nozzle plate. An electrode plate to actuate regions of the membrane may reside behind the flexible membrane and across a small air gap from it.

DETAILED DESCRIPTION OF THE EMBODIMENTS

Figure 1:
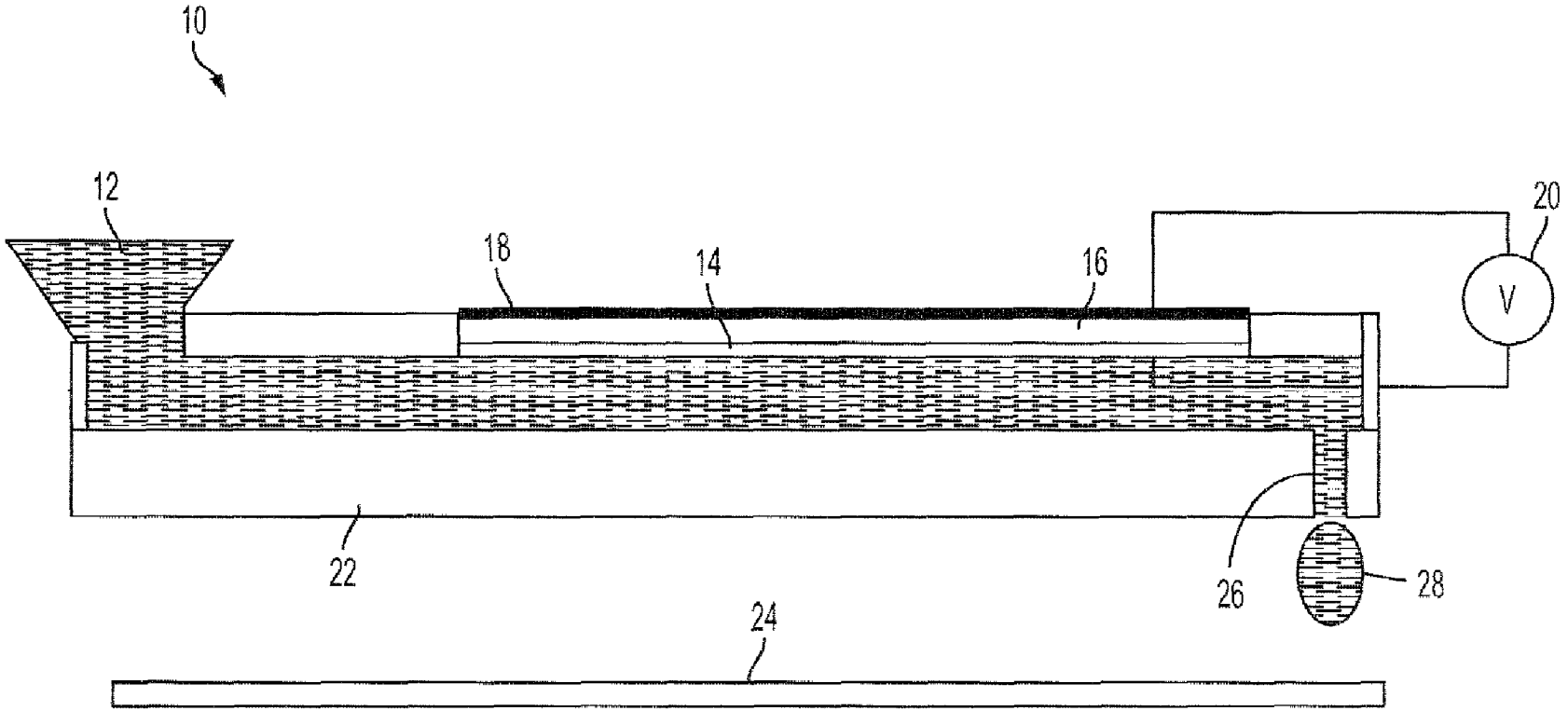
FIG. 1 shows a printing system using an electrostatically actuated membrane to dispense ink.

FIG. 1 shows a side view of a print head used in ink jet printing. The printhead 10 receives ink through an ink inlet 12. Generally, some sort of actuator pushes the ink shown in the shaded area selectively through an array of holes in a plate 22, such as shown by ink drop 28 through hole 26. The holes may also be referred to as jets or nozzles. The selective dispensing of ink through the array of holes onto the print substrate 24 forms the resulting print image.

The process of dispensing ink through the jets or nozzles generally results from control of a single actuator in an array of actuators. The density of the nozzles on the print plate will typically correspond to a print density. The print head selects which nozzles dispense ink by controlling individual actuators in the array of actuators. The actuators may consist of piezo-electric, microelectromechanical or any type of actuator that can receive a signal and generate a force that causes the ink to pass through the nozzle.

In the case of a microelectromechanical actuator, a flexible membrane 14 resides on the 'opposite' side of the ink reservoir shown by the shaded area from the nozzle plate 22. Behind the flexible membrane 14, across a gap 16, lies an electrode substrate 18. The electrode substrate 18 may be a fixed plate or other structure upon which an array of electrodes is arranged. The electrodes correspond to localized regions on the flexible membrane that allow selected ones of these regions to be actuated by application of a voltage from voltage supply 20. The localized regions in turn correspond to the array of ink jets or nozzles, allowing individual dispensing of ink through the nozzles. The deflection of the membrane causes a localized pocket of ink to form in the deflected membrane region that can then push through the nozzle when the membrane is released.

The flexible membrane may be of many different types of materials, including polymers, a thin layer or layers of metal, polysilicon, nitride, vinyl, etc. The surface of the membrane facing the electrode plate 18 will be conductive, so as to allow operation of the membrane as an actuator for the ink nozzles.

In operation, a voltage from supply 20 is applied to at least one electrode on the electrode substrate 18. The voltage differential causes an electrostatic attraction to build between the electrode and the localized region on the flexible membrane 14. When the strength of that attraction becomes strong enough, the localized region will deflect towards the electrode plate 18 into the air gap 16. This will cause ink to be drawn into the deflected region of the flexible membrane that contacts the ink.

When the voltage is removed, the flexible membrane will return to its undeflected state, pushing the pooled ink towards the nozzle plate 22. This in turn causes a drop of ink, such as 28, to exit the print head through the nozzle or hole located opposite the localized region on the flexible membrane, such as 26. In this manner, the selective deformation or deflection of regions of the membrane control the dispensing of ink drops to form an image on the surface of the print substrate 24.

However, using a uniformly thick membrane, or a membrane having uniformly thick localized regions, requires a relatively large electric field to cause adequate membrane displacement. In order to form an image, the ink drops displaced by releasing the membrane from its deflected or displaced state must have a certain volume. Due to the mechanical properties of the uniformly thick membrane, the deformation of the membrane does not collect a high enough volume of ink per a particular voltage level.

Figure 2:
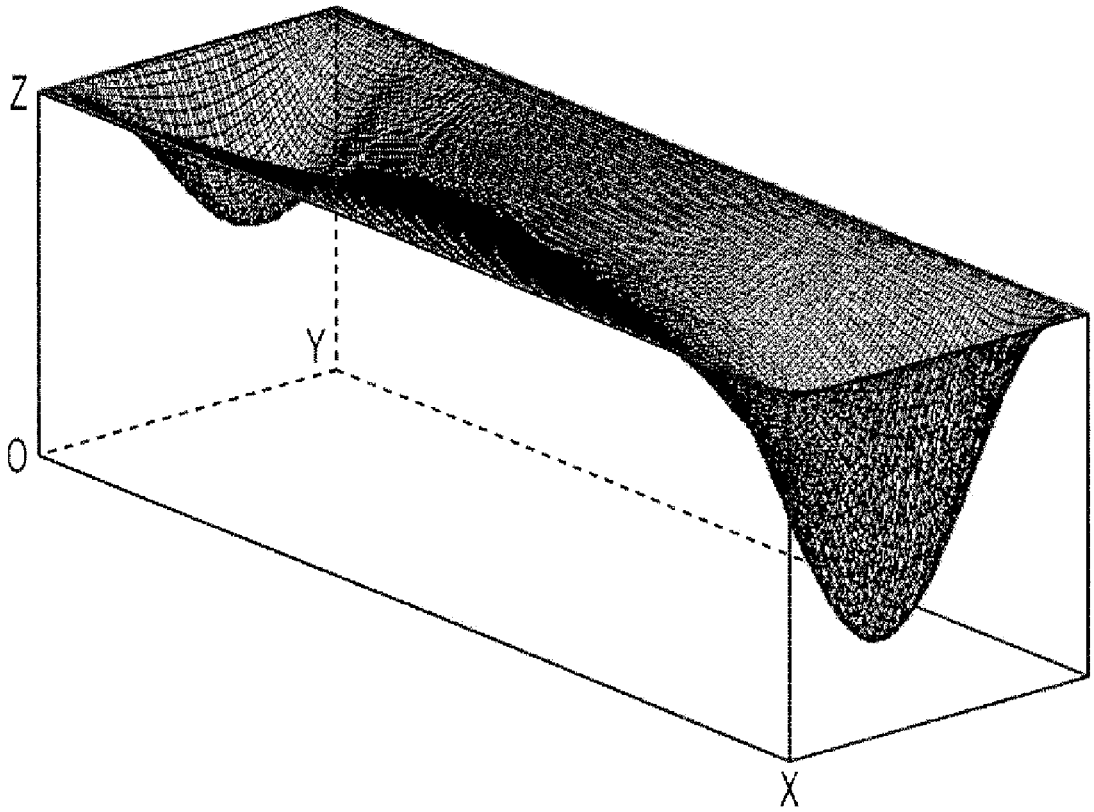
FIG. 2 shows a profile of a deflected or deformed membrane using a uniform thickness.

FIG. 2 shows a three dimensional example of a localized membrane region in its deformed or deflected state. As can be seen, the membrane does not deflect evenly, and in some areas, almost not at all. This reduces the amount of volume of the ink that is gathered in the displaced membrane. Increasing the electric field does not provide a solution, as relatively small air gap between the membranes limits the strength of the electric field applicable to the membrane. Too strong an electric field will cause electrical discharge that could damage the device.

Figure 3:
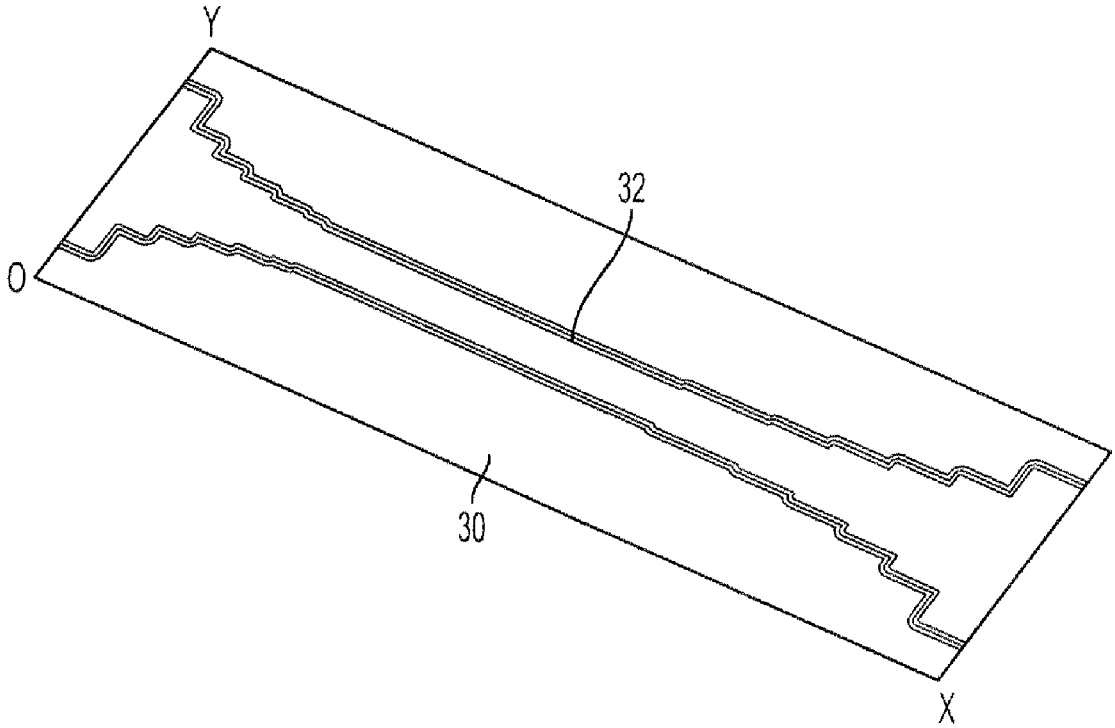
FIG. 3 shows an example of a membrane region having a stiffener.

In one embodiment, a localized region on the membrane such as 30 shown in FIG. 3, has a central stiffener region 32 formed along a center axis of the region. This stiffener may take many shapes, the shape of stiffener 32 consists of just one example. In one embodiment, a 100 micrometer (micron) wide actuator membrane of 1.5 microns thick had a central stiffener of 2.0 microns over the center 20 microns of the actuator membrane.

Figure 4:
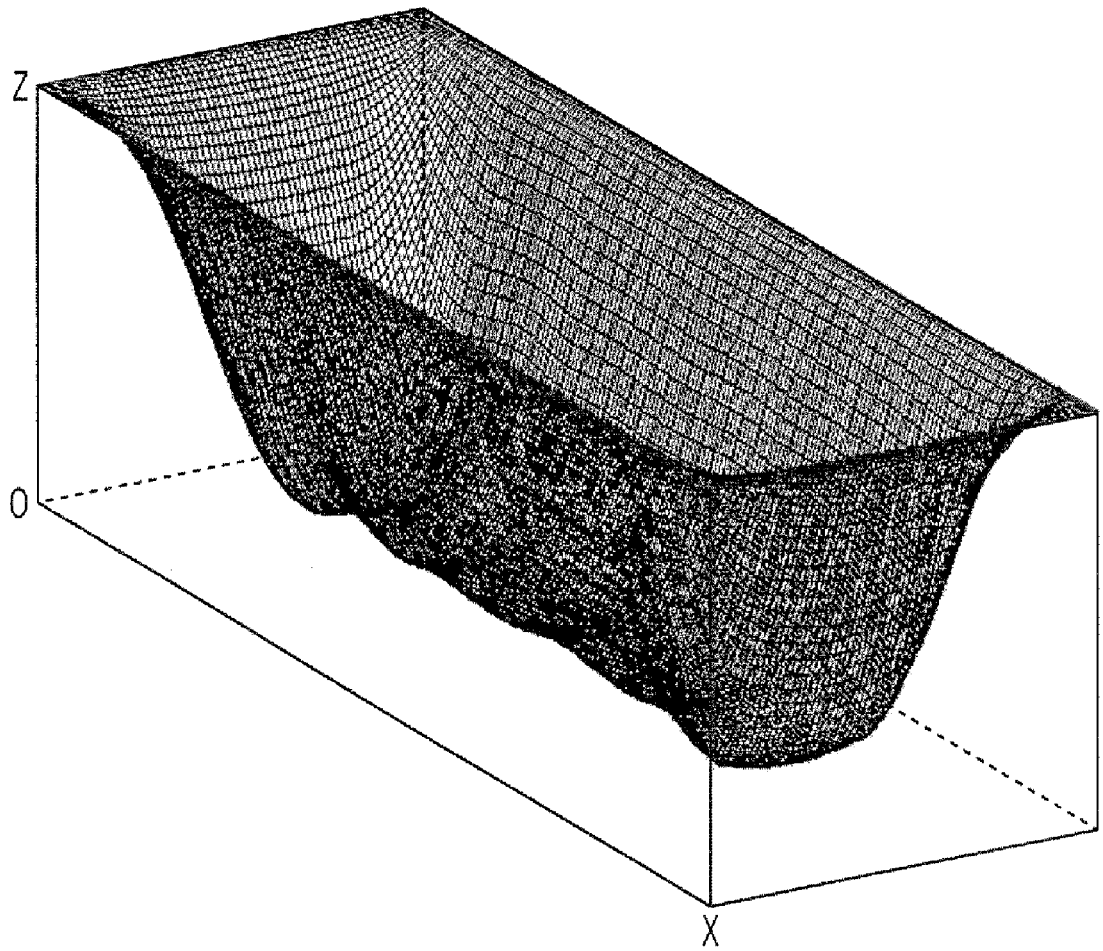
FIG. 4 shows a profile of a deflected or deformed membrane region having a stiffener.
Figure 5:
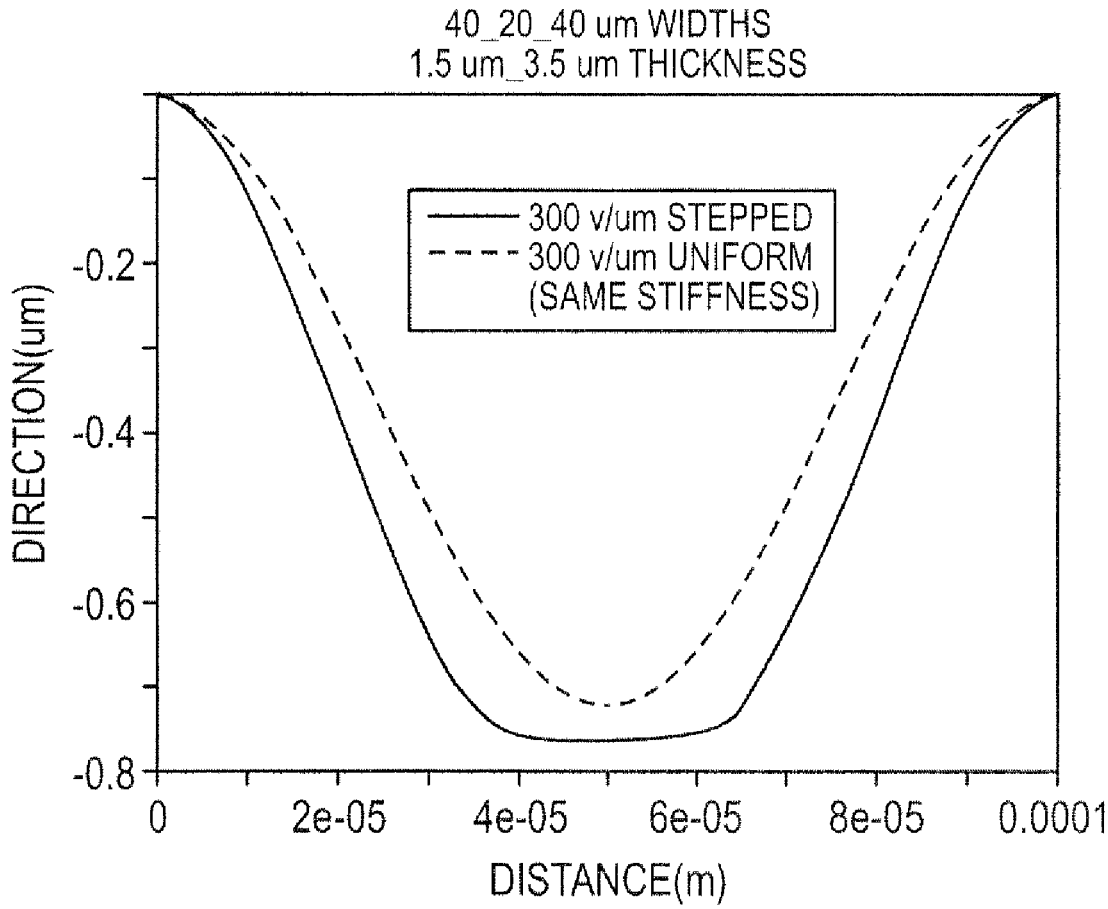
FIG. 5 shows a graph of voltages versus displacement for membrane deflections.

FIG. 4 shows the resulting displacement of the localized region 30 of FIG. 2. As can be seen in FIG. 4, the volume of the displacement achieved is much higher with the central stiffener. This higher displacement occurs with roughly the same electric field strength. A graph of the displacement versus the voltage is shown in FIG. 5 for a simpler two dimensional case. The upper line shows the displacement of a uniformly thick membrane. The lower line shows the displacement of a membrane with a central stiffener. This demonstrates that the use of a central stiffener yields a much larger displaced volume for the same maximum electric field even for a two dimensional case.

Figure 6:
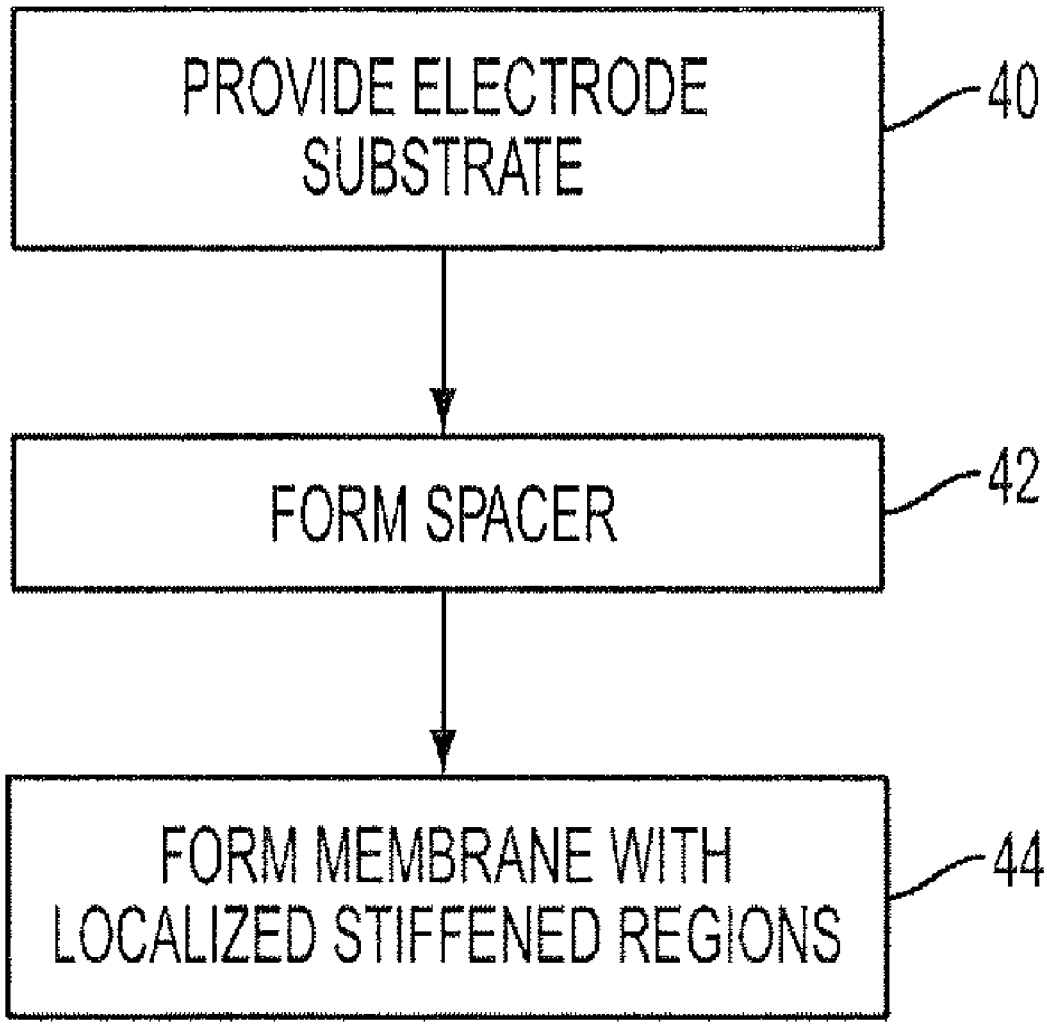
FIG. 6 shows an embodiment of a method of manufacturing a membrane device.

The manufacture of such a membrane will generally involve thin film processes, although several manufacturing processes are available to create a structure similar to that shown in FIG. 1. FIG. 6 shows one embodiment of such a process.

At 40, an electrode substrate such as 18 from FIG. 1 is provided. 'T'his may be an already existing plate on print head 10. A patterning and etching process may form electrodes, or the electrodes may be adhered to the plate, etc. An air gap would then be formed at 42 to result in the air gap, such as 16 in FIG. 1. As can be seen in FIG. 1, the air gap is formed from the housing of the printhead 10, where the electrode plate is flush with one side of the housing and the flexible membrane resides in a recessed portion of the print head. Alternatively, standoffs such as metal plates with recesses in them may be used, as well as many other options to form a gap such as between the flexible membrane 14 and the electrode plate 18 of FIG. 1.

The flexible membrane having localized regions is then arranged across the gap from the electrode substrate in 44. The flexible membrane may be a single sheet of conductive material or polysilicon that subsequently receives a second layer of conductive material or polysilicon. The second layer of conductive material or polysilicon would be patterned and etched to form the central stiffeners in the localized regions. Alternatively, the membrane could be pre-formed with the localized regions having stiffeners, or stiffeners could be adhered onto the flexible membrane, etc.

The resulting structure would have an electrode substrate across an air gap from a flexible membrane. The flexible membrane would have one surface in contact with the ink in the reservoir such that when localized regions deflect, they would cause the ink to pool or collect in the displace region. When the membrane is released by manipulating a voltage applied to the membrane from the electrode substrate, the ink would push out the nozzle plate onto the printing substrate.

In this manner, an electrostatic actuator for an ink jet print head has a stiffener that allows the actuator to provide a higher volume of displaced ink for a same electric field than actuators without the stiffener. The stiffener is manufacturable using the same or similar processes as that used to manufacture the electrostatic actuator.

It will be appreciated that several of the above-disclosed and other features and functions, or alternatives thereof, may be desirably combined into many other different systems or applications. Also that various presently unforeseen or unanticipated alternatives, modifications, variations, or improvements therein may be subsequently made by those skilled in the art which are also intended to be encompassed by the following claims.

What is claimed is:

1. An apparatus, comprising:

an electrode plate having an array of electrodes;

a flexible membrane separated from the electrode plate by a gap, the membrane having localized regions corresponding to electrodes in the array of electrodes; and each localized region having a stiffener.

2. The apparatus of claim 1, the electrode plate further comprising a plate of a print head.

3. The apparatus of claim 1, the flexible membrane further comprising a conductive material or polysilicon membrane.

4. The apparatus of claim 1, the stiffener arranged in a center region of each localized region.

5. The apparatus of claim 1, wherein each electrode corresponds to each localized region arranged so as to selectively actuate a corresponding localized region.

6. The apparatus of claim 5, the apparatus further comprising a nozzle plate.

7. The apparatus of claim 6, the nozzle plate further comprising an array of nozzles, each nozzle corresponding to a localized region.

8. A print head, comprising:

an ink reservoir;

a nozzle plate to deliver ink from the reservoir to a print substrate;

an ink inlet on an opposite side from the print substrate to provide ink from the reservoir to the nozzle plate; and a flexible membrane arranged so as to draw the ink through the ink inlet when actuated and to dispense the ink through the nozzle plate when released, the flexible membrane having a stiffener.

9. The print head of claim 8, the print head further comprising a solid ink jet print head.

10. The print head of claim 8, the print head further comprising an electrode substrate having an array of electrodes.

11. The print head of claim 10, the electrode substrate being arranged across an air gap from the flexible membrane.

12. The print head of claim 10, wherein each electrode in the array of electrodes corresponds to a localized region on the flexible membrane.

13. The print head of claim 12, wherein each region on the flexible membrane corresponds to a nozzle in the nozzle plate.

14. The print head of claim 8, the flexible membrane further comprising an array of localized regions.

15. The printhead of claim 14, wherein the stiffener further comprises a stiffener on each localized region.

16. The printhead of claim 15, wherein the stiffener is located in a center of each localized region.

17. A method of manufacturing a membrane device, comprising:

providing an electrode plate having an array of electrodes;

forming an air gap adjacent the electrode plate; and forming a membrane of conductive material having localized regions with a stiffener separated from the electrode plate by the air gap, the localized regions corresponding to electrodes in the array.

18. The method of claim 17, wherein providing further comprising forming an array of electrodes on a plate of a print head.

19. The method of claim 17, wherein forming a membrane further comprises adhering a conductive material or polysilicon 1 membrane to a plate in a print head.

20. The method of claim 17, the method further comprising providing a nozzle plate opposite the membrane such that when the membrane is deflected towards the electrode substrate and then released, ink flows through nozzles in the nozzle plate.

* * * * *